United States Patent [19]

Hansen

[11] 4,063,426

[45] Dec. 20, 1977

[54] THREE COLUMN TOWER

[76] Inventor: Frode Johan Hansen, 19 Elm Lodge, River Gardens, Stevenage Road, London, England

[21] Appl. No.: 695,170

[22] Filed: June 11, 1976

[30] Foreign Application Priority Data

June 11, 1975 United Kingdom ..... 25076/75

[51] Int. Cl.[2] ..... E02B 17/00

[52] U.S. Cl. ..... 61/94; 61/87; 61/88; 61/98

[58] Field of Search ..... 61/87, 88, 89, 94, 86, 61/90–93, 95–104

[56] References Cited

U.S. PATENT DOCUMENTS

| | | | |
|---|---|---|---|
| 1,063,942 | 6/1913 | Phillips | 61/53.74 |
| 1,853,379 | 4/1932 | Rotinoff | 61/53.74 X |
| 2,398,351 | 4/1946 | Baker | 61/87 |
| 2,775,095 | 12/1956 | Harris | 61/94 |
| 2,857,744 | 10/1958 | Swiger et al. | 61/87 |
| 3,128,604 | 4/1964 | Sandberg | 61/87 |
| 3,815,371 | 6/1974 | Koehler | 61/94 |

FOREIGN PATENT DOCUMENTS

| | | | |
|---|---|---|---|
| 2,407,655 | 8/1975 | Germany | 61/87 |

*Primary Examiner*—Dennis L. Taylor

*Attorney, Agent, or Firm*—Karl W. Flocks

[57] ABSTRACT

A marine structure comprising a plurality of hollow vertical columns tied permanently together by bracing elements at their lower and upper portions with cross bracing elements within their lengths to form a rigid tower, the columns having hollow feet open at their lower ends to be sunk into a sea bed, an excavating mechanism inside the feet for excavating sea bed material. Each column of the structure is floatable in water and is provided with inlet through which ballast may be introduced to sink it vertically in the water. A method of constructing a marine structure comprising making a plurality of hollow columns, bracing the columns together at their end portions and between their end portions to form a horizontally disposed rigid buoyant structure such that when erected on the sea bed no horizontal bracing members are in the critical wave zone, assembling hollow feet on the columns, floating the structure to the site with the columns substantially horizontal, ballasting one end portion of the columns to upend the structure into a substantially vertical position and to sink the structure onto the sea bed, and excavating the sea bed within the feet to enable the structure to be seated firmly in the upright position at a suitable foundation depth in the sea bed.

13 Claims, 23 Drawing Figures

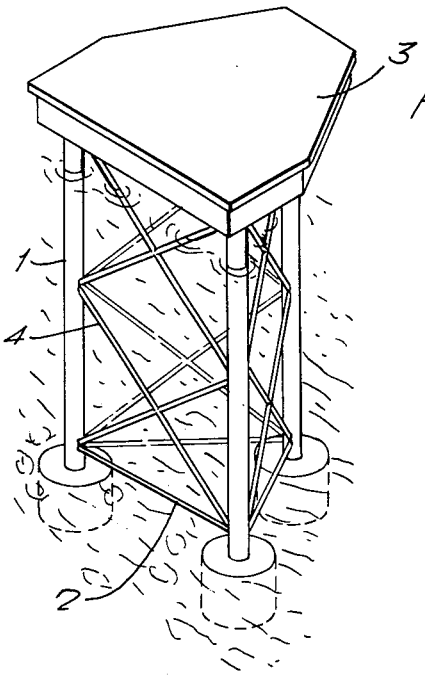
FIG. 1
FIG. 3
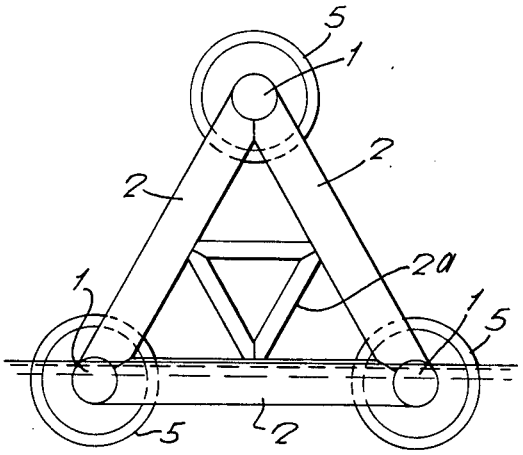
FIG. 2
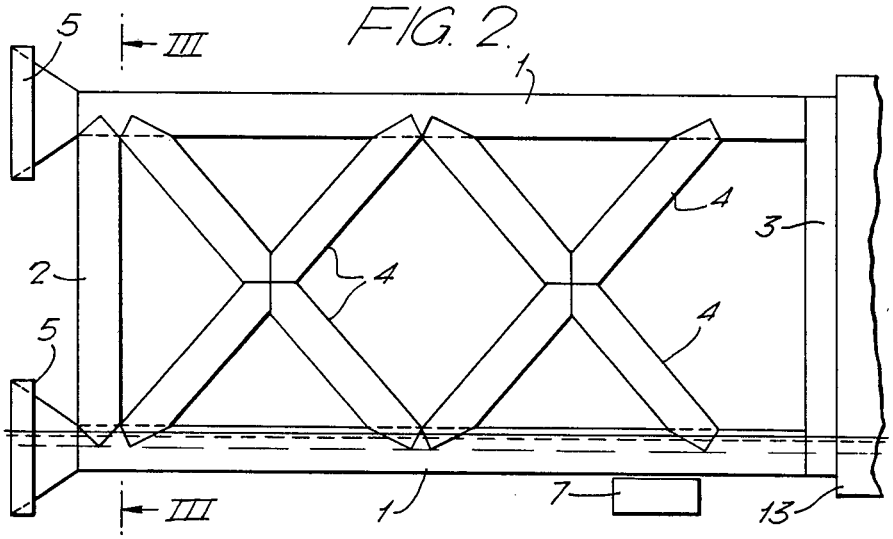

THREE COLUMN TOWER

BACKGROUND OF THE INVENTION

This invention relates to marine structures and to methods of constructing and erecting them.

Marine structures are used as platforms for drilling undersea oil wells and as oil or gas production platforms, but they can be used for other purposes such as lighthouses, storage tanks and single point moorings.

The problems of constructing offshore marine structures are known to increase with the water depths at the site, particularly at water depths exceeding 6–700 feet, and these problems are further aggravated when the site is exposed to winds and waves calling for bigger structures and leaving less time for their construction offshore. It is therefore necessary to construct such structures as far as possible at an inshore base, transport them to site when they are as near as possible to completion and devise methods for installing them safely on site in the shortest possible time with minimum interference from winds and waves.

In the past, such structures were constructed as prefabricated tubular steel space frames which were secured to the sea bed by pile driving, relying on very heavy floating equipment for the pile driving and the subsequent installation of the deck structure and all the drilling and production equipment well above the highest wave crest. In deep and exposed water this offshore installation period may become so long that there is not enough good weather time for the operation.

The present trend is to construct such structures as large floating concrete bases, compartmented in various ways, from which a number of vertical towers rise to such a height that they can reach above the highest wave crest and support the required deck structure and deck installations. It is possible to design structures along those lines which can float safely in a vertical position and remain stable during all stages of floatation, towing to the site and sinking to the sea bed. It is also possible to found such structures directly upon the sea bed quite quickly and without too much dependence upon winds and waves. To some extent this approach to offshore constructions overcomes the problems created by deep and exposed waters, but it still suffers from some distinct disadvantages.

The criteria for floating stability are however in direct conflict with the criteria for attracting minimum wave forces when resting on the sea bed and in consequence make the structures heavier and bulkier than the permanent conditions on the sea bed require. The structures furthermore require deep water for their construction and they become more economic the deeper the construction site is, since the conflict between floating and fixed stability becomes less acute. Very few suitable sites are available in areas such as surround Great Britain where that type of structure can be constructed competitively and the penalty for installing deck load on the structure before towing to site is very heavy insofar as it calls for even deeper water for construction or increases the size of the structure disproportionately. This again causes increased wave loads on the structure and increased foundation stresses which may become critical since structures of this nature for their safety are very dependent upon the strength of the upper soil strata and those strata often are quite weak. This limits the use of this type of structure — and this limitation is further aggravated by the fact that the results of detailed soil surveys of the site in question quite frequently only become available a long time after the demand for the structure has been established. But since such soil information is required at the very beginning of the design and construction of the platform it imposes on the designer the strain of having to design a structure for rather ill-defined foundation conditions, and on the contractor of having to start construction of a not yet fully designed structure — causing ultimately a most unwelcome delay in the delivery of the platform.

The main object of the present invention is to provide a marine structure in which the aforesaid problems have been greatly reduced and the structures consequently have become correspondingly easier and cheaper to design, construct and finally install in the sea bed. The structure in accordance with the present invention is governed by its floating stability and its required strength for temporary conditions, e.g. during erection being in harmony with permanent environmental and operational conditions. It does not require deep water for its construction and plenty of suitable construction sites can be found in most countries including Great Britain. The main purpose of the structure is to support heavy deck loads above the crest of the waves and such heavy loads can be installed before tow-out without a heavy structural penalty. It does not call for a deep water installation site, the operation is well within the capacity of ordinary floating crane capacity and it has no bearing on the final structural design, but it does require the introduction of additional temporary buoyancy elements. The structure in accordance with the present invention does however lend itself naturally to having the deck structure, complete with all the required drilling and production facilities, installed after tow-out since the basic structure, quite naturally, after the final founding in the sea bed can be stopped at a suitable depth below the water surface, and the superstructure in the shape of a conventional "jack-up" platform can be floated into position, landed on the three columns and jacked up.

Futhermore, the proposed method of foundation makes the structure independent of the sea bed topography and less dependent upon the weak upper soil strata and finally the most important feature, the proposed construction method permits the supporting feet to be constructed last and thus provides time for the design of the feet to be based upon up-to-date soil investigations without causing delays to the construction and therefore ultimately producing a quicker delivery of the structure.

According to the present invention a marine structure comprises three substantially vertical columns tied permanently together by bracings at their lower and upper portions with cross bracings within their lengths to form a rigid tower and feet at their lower ends to be sunk into the sea bed with means for excavating sea bed soil material inside the feet.

Preferably the columns are braced together at their top portions and lower portions by horizontal braces, the lower brace being adjacent to the sea bed in the erected structure and the upper brace being disposed at the upper end of the structure above the highest wave crest possible at the site, forming part of the deck structure.

The bracings within the lengths of the columns may be formed in sets fixed between adjacent columns, each set comprising two crossed members lending themselves for prefabrication horizontally before being secured to the columns.

Each column preferably has a conical hollow foot open at its lower end and having access means through which means for excavation may be passed to excavate the sea bed beneath the foot, as well as for inspection, sampling and testing before backfilling takes place. The hollow space in each foot is designed to provide buoyancy during construction and tow-out and to reduce the ground pressure underneath the foot if required.

Each column is a floatable structure with means by which it can be filled with ballast, e.g. water, to sink the structure in the water. Buoyancy tanks may also be attached temporarily to support the upper end of the floating columns and the required superstructure attached to the columns. The buoyancy tanks may be capable of ballasting and deballasting as with water to assist in maneuvering and supporting the structure when floating and sinking it to the sea bed.

From another aspect of the invention a method of constructing a marine structure according to the invention comprises making three hollow columns, bracing the columns together at their end portions and between their end portions to form a horizontally disposed rigid buoyant structure such that when erected on the sea bed no horizontal bracing members are in the critical wave zone, assembling hollow feet on the columns, floating the structure to the site with the columns substantially horizontal, ballasting one end portion of the columns to upend the structure into a substantially vertical position and to sink the structure onto the sea bed, and excavating the sea bed within the feet to enable the structure to be seated firmly in the upright position at a suitable foundation depth in the sea bed.

BRIEF DESCRIPTION OF THE DRAWINGS

In order that the invention may be more fully understood, a construction in accordance therewith will now be described by way of example with reference to the accompanying diagrammatic drawings in which:

FIG. 1 is a perspective view of an erected structure;

FIG. 2 shows in elevation a completed structure floating on water at the construction site;

FIG. 3 is a cross section through the line III—III of FIG. 2 looking in the direction of the arrows;

DETAILED DESCRIPTION OF THE INVENTION

Figure 4:
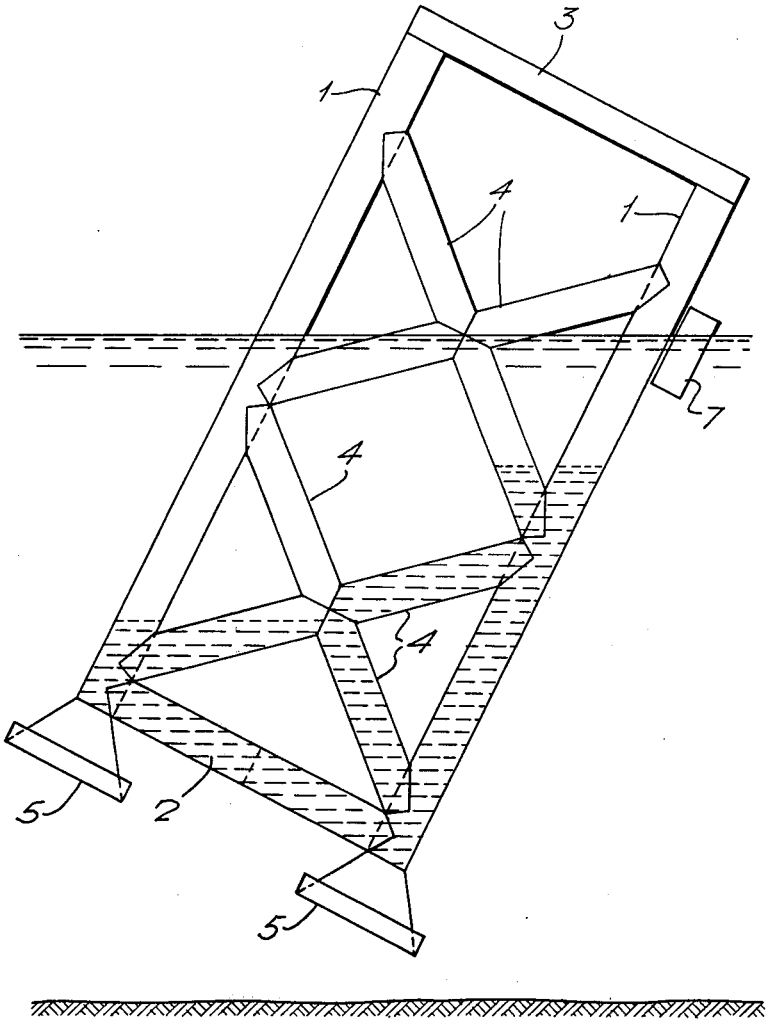
FIG. 4 shows the structure of FIG. 2 at the site during the sinking operation.

Referring to FIGS. 1 to 4 the structure comprises three columns 1 braced together by horizontal braces 2 and 3 with cross braces 4, each of the columns having a foot 5. The general concept of the structure is that although the columns may have to be very long, they can be constructed in a horizontal position and the structure can be floated in shallow water with only one side submerged so that the whole structure can be towed in the horizontal position floating on the water to the site, and then upended and sunk onto the sea bed with the upper end rising above the surface of the waves at the site. Each column and bracing member (except the top bracing which is out of the water when the tower is being upended) is a circular cylinder of a diameter large enough to provide the required buoyancy and water plane area to float in shallow water and to maintain floating stability during all stages of the towing to the site and the upending and sinking steps.

The three columns 1 are joined together by two horizontal bracing systems consisting of brace members 2 at the bottom of the structure and 3 at the top of the structure. Each of these bracing systems comprises the horizontal members 2 and 3, there being a member 2 and 3 extending between each column so that in plan in the erected structure the systems 2, 3 are triangular with the columns at the angle. A secondary set of bracing members, 2*a*, forming a triangle of half size and connecting the middle points of the three bracing members 2 may be added in order to strengthen the bracing and side support to conductor guides and various pipe connections rising from the sea bed.

Figure 6:
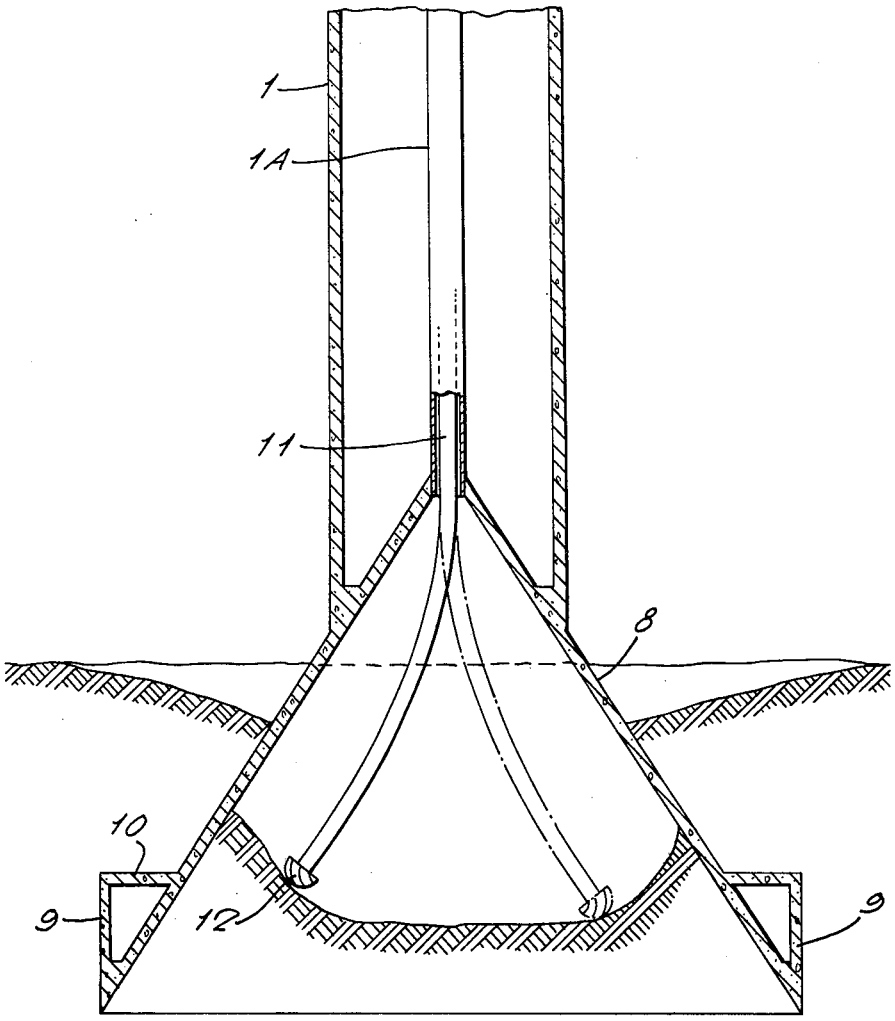
FIG. 6 shows one form of construction of the foot of one of the columns of the structure of FIGS. 1 to 5 showing the excavating means.
Figure 13A:
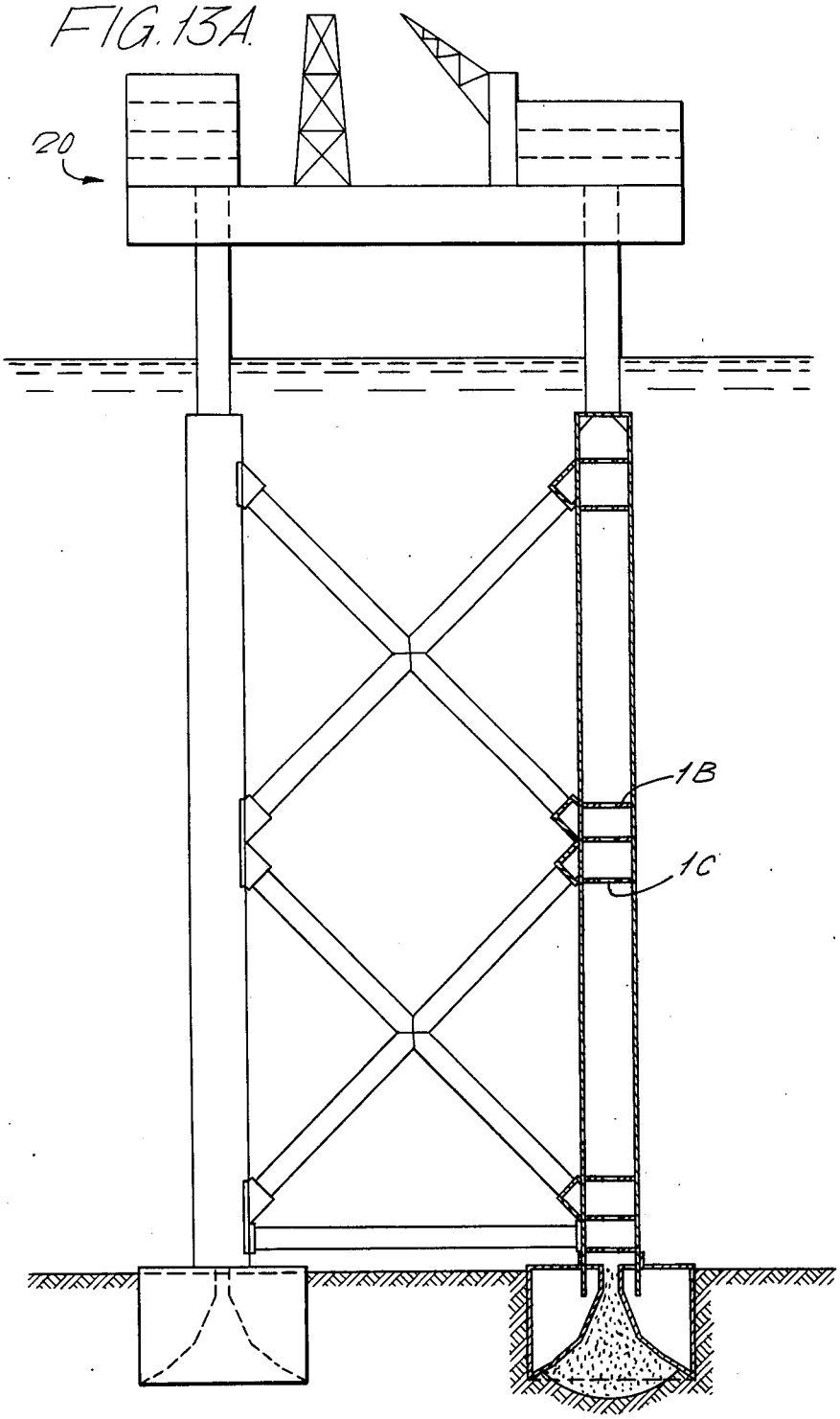
FIG. 13A shows a typical two-stage construction method for the proposed structure.

Each column is made tubular and may be of reinforced or prestressed concrete or steel. It has a central sleeve or duct through it shown at 1A in FIGS. 6 and 7 for the purpose to be described; alternatively each column may have vertically spaced horizontal diaphragms 1B (FIG. 13A) with central holes 1C for the same purpose.

The columns are interbraced between their ends by the diagonal bracing members 4 shown in the form of a cross but they can be arranged in any geometrical configuration to ensure that the whole stability of the structure is maintained with a minimum number of bracing members, having in mind that the main aim is to achieve a structure which offers minimum resistance to wave action and has no horizontal members in the critical wave zone. The bracing members 4 may be of steel or of other rigid material such as reinforced or prestressed concrete but as shown in FIG. 3 they may be hollow and can be flooded with water during the sinking operation. Functioning as diagonal bracing members they will during wave action on the erected structure be subject to tension and compression forces of equal magnitude, the bracing members 4 may preferably be made of steel, which also gives them additional natural buoyancy which is an advantage during the tow-out and upending operations.

The structure thus described is made to float in the manner shown in FIG. 3 so that the two columns indicated at the bottom of FIG. 3 plus their corresponding bracing members 2, 4 are sufficiently buoyant to hold the whole structure on the surface of the water. If desired a superstructure or deck structure may be built onto the top end of the columns at the inshore construction site, in order to avoid erecting the platform or superstructure on the tower once it has been established on the sea bed. This whole operation is reversible so that the structure can be raised and towed to the new site. For this purpose buoyancy tanks 7 can be temporarily attached to the floating structure and thereby give added buoyancy at the top end of the structure which will counteract the downward forces arising from the weight of the superstructure attached to the main structure. These buoyancy tanks can be provided with means for flooding and deballasting should this be necessary during the upending and sinking operation. With this appraoch it is possible to install any amount of deck load before tow-out without running into floating stability problems. The temporary buoyancy tank remain close to the surface. They are therefore not subject to great hydrostatic pressures and consequently of quite ordinary design. Any amount of drilling and production equipment can be installed before towing the structure to site, as long as the items in question can accept a gentle rotation through 90° during the upending movement.

The feet 5 each comprise a conical section 8 which is surrounded at its bottom end by a circular sleeve 9 connected at 10 to the outside of the cone 8. The shape of the feet, i.e., the bottom diameter, the height of the sleeve 9 and the overall height of the conical section 8, is such as to make it suitable for the conditions of the sea bed at the site as determined by the sea bed soil survey.

The sleeve, tube or hole 1A in the column 1 opens out into the top of the conical part 8 through which a pipe 11 can be passed which may carry either a suction pipe or form a suction pipe and have at its lower end one or more cutter heads 12. If desired the suction pipe and the pipe carrying the cutter 12 could be separate pipes which run side by side in the sleeve 1A or they could be withdrawn and replaced one for the other. The sleeve or hole 1A should preferably have such a large diameter that a diver or a diving bell possibly could pass down into the foot if something completely unforeseen should happen, or enable operators to inspect, test or sample the sea bed in or beneath the foot before backfilling.

Figure 8:
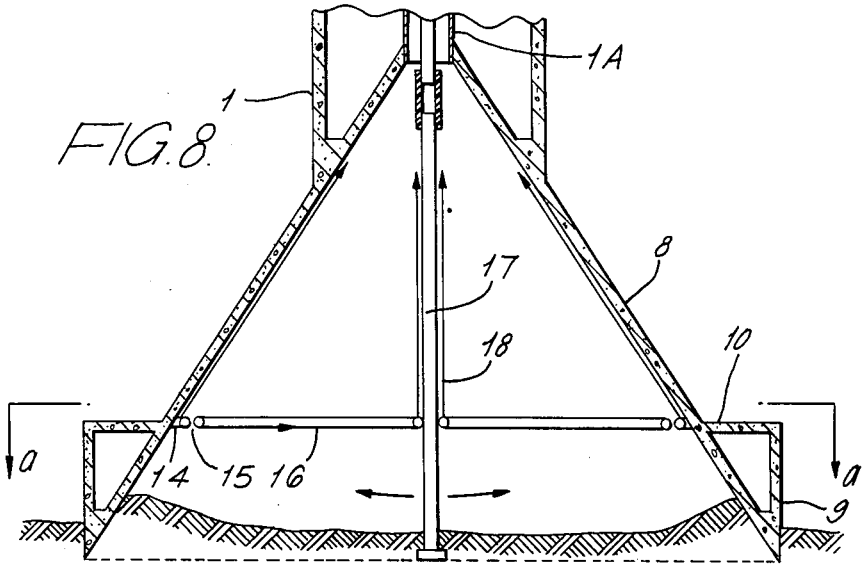
FIG. 8 is similar to FIG. 6 but shows in more detail how the excavating means may be operated.
Figure 9:
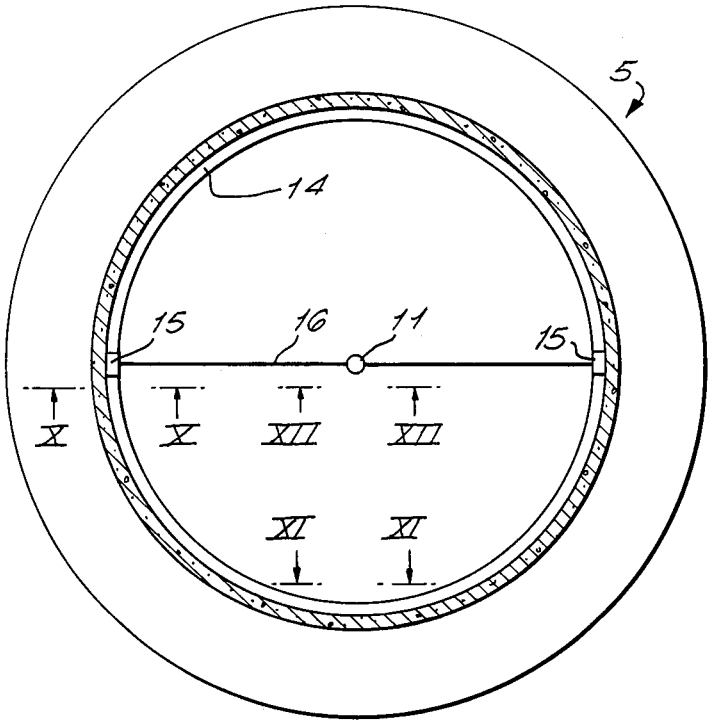
FIG. 9 is a plan section of FIG. 8 looking downwards showing more details of the excavating means.
Figure 10:
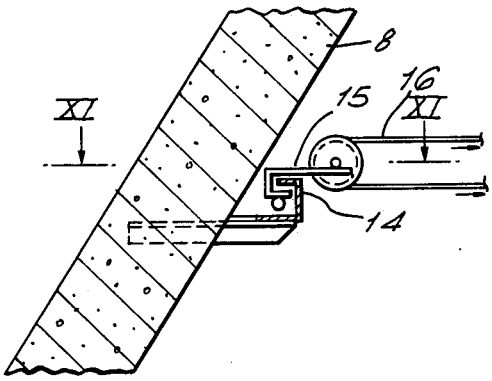
FIG. 10 is a cross section on the line X—X of FIG. 9 drawn to a larger scale.

It is important to be able to guide the cutter-suction head to any part within the foot and at that part exert a force of a substantial magnitude as required to carry out the excavation process effectively. FIGS. 8 to 10 show one way of achieving this objective.

A horizontal guide rail 14 for two movable anchor blocks 15 is fixed to the conical wall 8. The two anchor blocks 15 are placed at diametrically opposite points on the guide rail. Each block is kept in position by a wire rope 16 running on the inside of the guide rail and through a number of guide tubes 17 taken up to a winch on the deck. By a simple winching operation it is then possible to locate these two anchor blocks anywhere along the perimeter of the conical wall.

Another set of wire ropes 18 connect the suction pipe 11 to the two anchor blocks and another simple winching operation from the deck enables the cutter-suction head to reach any point on the diameter between the two anchor blocks and at each point exerting a force governed by the weight of the cutter-suction assembly (including the weight of the pipe) and the winching force applied.

Figure 11:
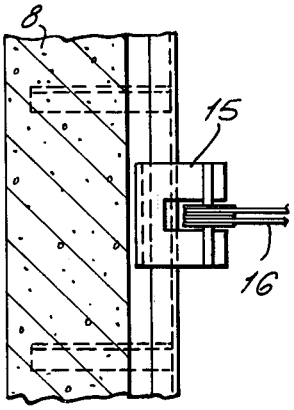
FIG. 11 is a cross section on the line XI—XI of FIG. 10.
Figure 12:
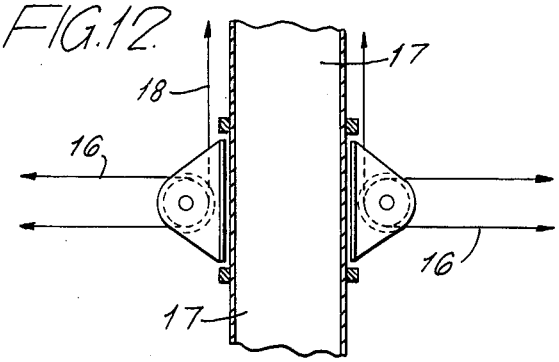
FIG. 12 shows more details on the line XII—XII of FIG. 9 to a larger scale of the means for operating the excavation tool.
Figure 13:
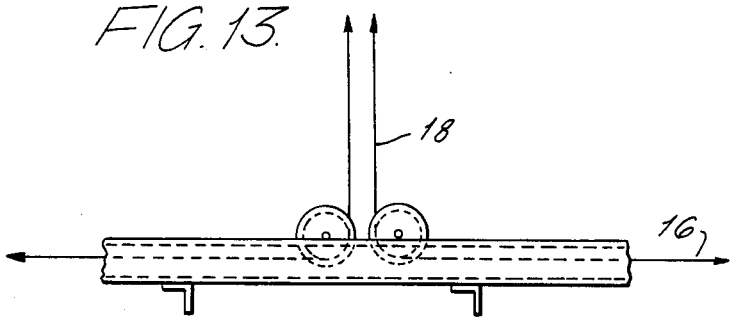
FIG. 13 is a detail to a larger scale on the line XIII—XIII of FIG. 9.

The proposed structure could be constructed in a number of ways. FIG. 11 shows a typical two-stage construction.

The first stage is to construct one side of the structure; i.e., two columns with their interconnecting bracing members, in a purpose made dry dock. Without the feet this part of the structure can float in less than 5m of water, so the dry dock may be so shallow that it can be established without difficulty in most ground conditions.

Having completed the first stage construction the dry dock is flooded and the structure is floated to a sheltered place where it can be completed while floating. A suitable construction method to adopt for this second stage is the free cantilever construction method generally used for major concrete bridges spanning over wide rivers or crossing inaccessible or soft ground.

The 2 feet may be constructed in the water line as two separate units, floated into position and stressed to the columns. The third foot on the column may then be constructed in-situ using the cantilever method.

The buoyancy tanks 7, if used, are then attached to one or both of the floating columns and finally the superstructure indicated at 13 in FIG. 1 is then built onto the structure. The structure thus built is capable of floating in shallow water.

Ignoring the feet it is quite feasible to construct a structure, say 1,000 feet long which will float in 10–12m water depth. Taking the feet into account, it is likely that the required water depth would be 20–25m, but this is still quite shallow and can be found on many locations.

The structure can then be towed to the site where the sinking operation is to be carried out. As seen in FIG. 4 the sinking operation is carried out by flooding the columns 1 and the lower brace members 2 and as an optional feature the braces 4 or part of them. Each of these parts of the structure has appropriate valve means controlled from the top end of the structure to control the inflow of water.

As can be seen from FIG. 4, the flooding of the structure members will start at the lower end of the final structure which is in the water and thus the structure begins to tilt in the water and at the same time to sink. The tilting can be controlled to any speed required and can be stopped at any time or reversed.

Figure 5:
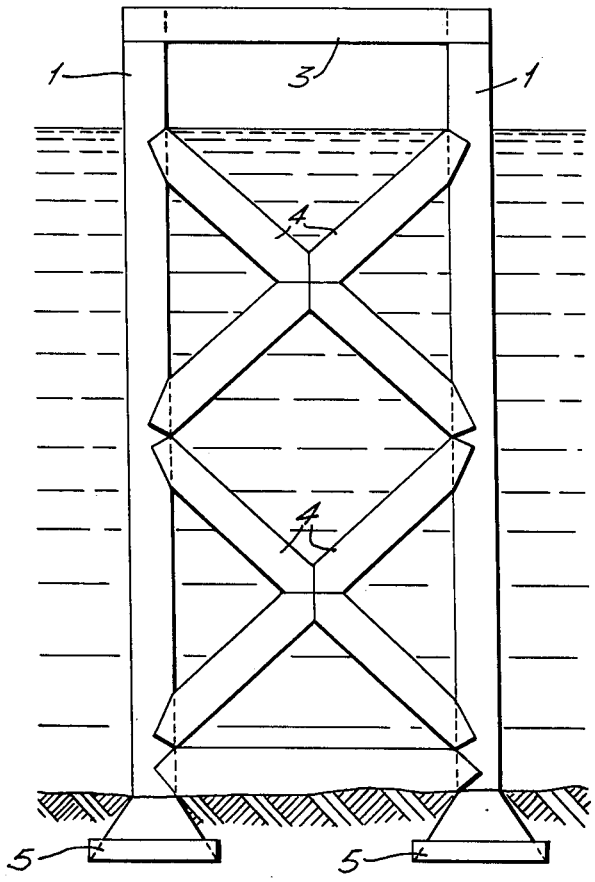
FIG. 5 shows the same structure sunk on the sea bed at the site.

As the flooding continues the structure will gradually move into an upright position and float vertically without any of the feet touching the sea bed or sink until two of the feet 5 engage the sea bed. By continuing flooding the structure will touch down on all three feet more or less simultaneously dpending on the sea bed topography or by continuing the flooding of the third column the foot of which is not yet in contact with the sea bed, and possibly by deballasting the two other columns or the buoyancy tank, the structure is brought into an upright position with all three feet engaging the sea bed. At the juncture the cutter head is brought into operation as seen in FIG. 5 to cut away the material of the sea bed which is then sucked up through the pipe 11 and discharged into the surrounding water or it may be discharged into floating pontoons or like structures for use in backfilling of the feet at a later period of the operation. As the cutter head cuts away the sea bed within the conical foot 8 the foot sinks into the ground and this operation continues until all the feet are firmly based in the sea bed with the column vertical.

Finally, when the feet have reached the required foundation they are secured at that depth by backfilling the conical space underneath the feet with granular material such as sand or gravel and if need be the hollow space inside the feet and part of the column and/or the braces. The backfill of coarse granular material underneath the feet serves a double purpose of making it possible to drain the feet and controlling the pore water pressure underneath the structure as well as facilitating a recovery of the structure after it has served its useful life in this particular site location.

The superstructure 13 and the deck installations are then completed insofar as is necessary and the platform is ready for the operation for which it is intended.

Figure 14:
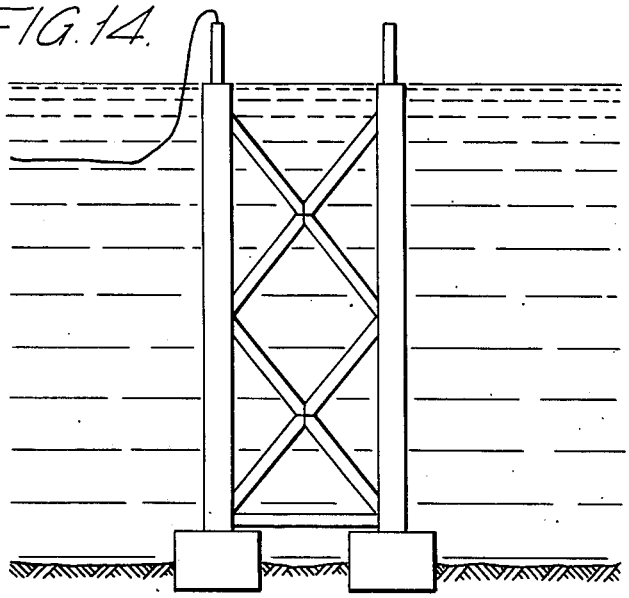
FIG. 14 shows a view similar to FIG. 5 of an alternative construction.

Referring to FIGS. 14 to 21 these show an alternative construction similar in principle to the construction described with reference to FIGS. 1 to 13A. In this alternative construction the structure is constructed as two separate units, the first forming a basic structure with the braced legs 1 and the second forming the superstructure 20. The superstructure 20 is constructed to be buoyant so that it can be floated and towed to the site separately from the basic structure and preferably as shown in FIG. 14 complete with drilling and production equipment and facilities; it can be mounted on the erected basic structure at the site by a conventional self-contained jack-up procedure so as to be above the highest predictable waves at the site. The superstructure can form the upper horizontal bracing member 3 (FIGS. 2–4).

Figure 7:
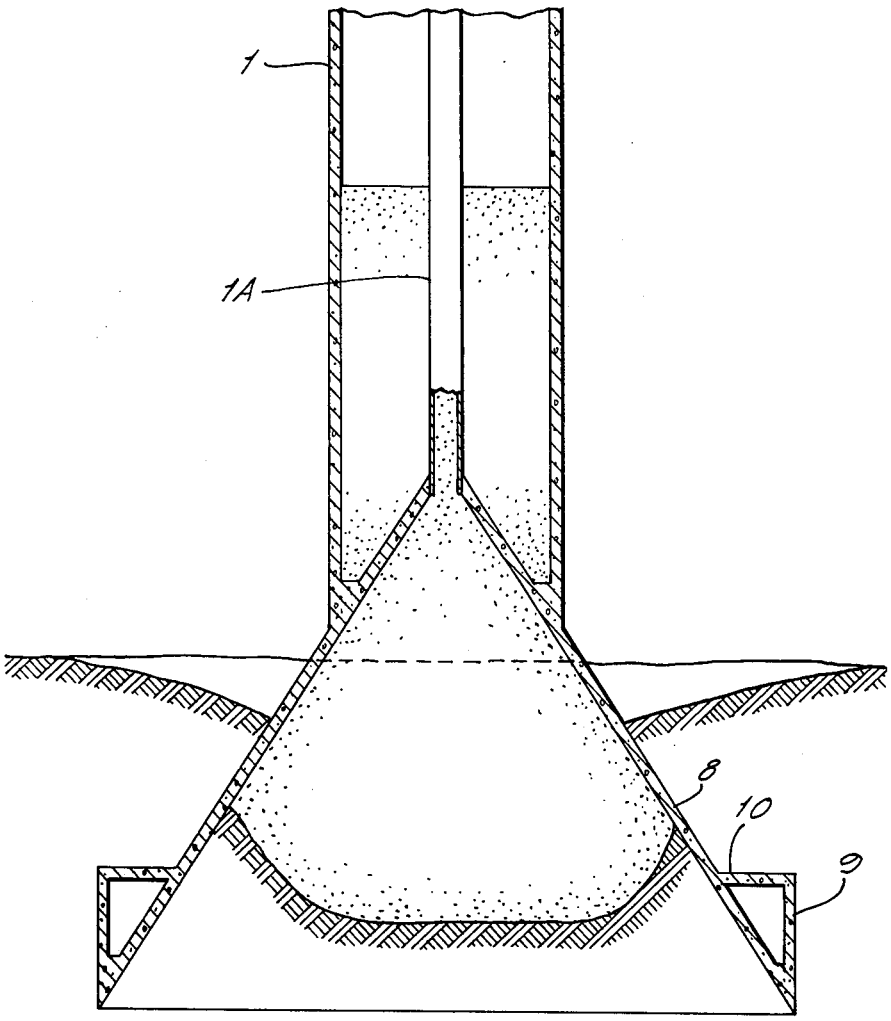
FIG. 7 is a view similar to FIG. 6 in cross section and showing the foot seated in the sea bed and filled with granular material (sand or gravel) to give the foot maximum carrying capacity and to limit further penetration into the sea bed.
Figure 15:
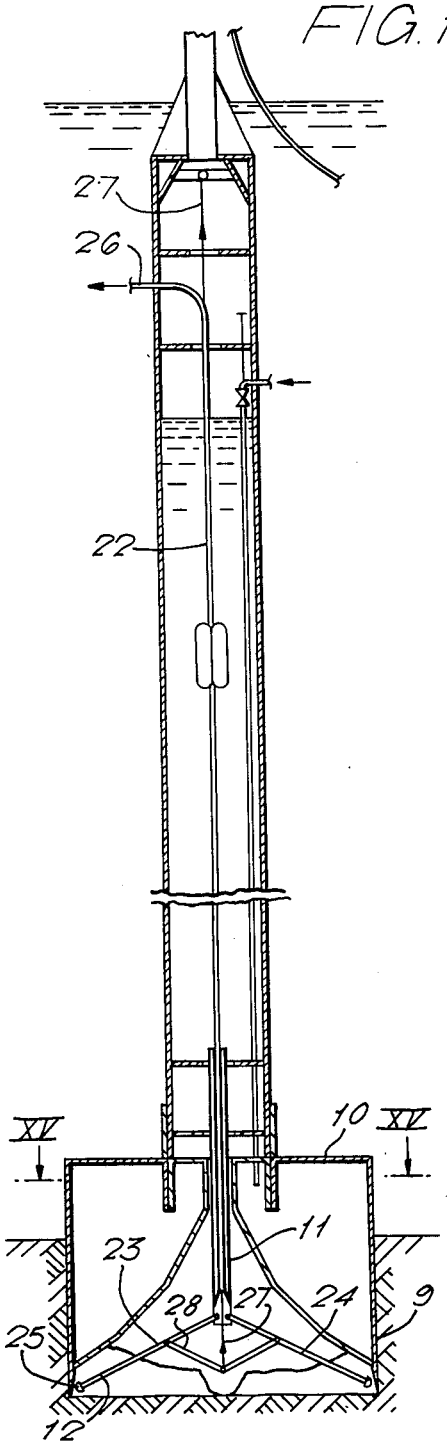
FIG. 15 is a cross section through one leg of one form of marine structure.

FIG. 15 shows another form of foot 5 having a conical section 8 enclosed within a hollow sleeve 9 and roof 10 of greater size than the construction in FIGS. 7 and 8. This construction gives the foot more natural buoyancy in the tow-out and reduces the final ground pressure underneath the foot when finally installed in the sea bed than the form shown in FIGS. 7 and 8.

Figure 16:
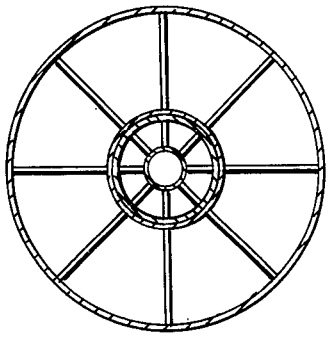
FIG. 16 is a cross section on the line XV—XV of FIG. 15.
Figure 17:
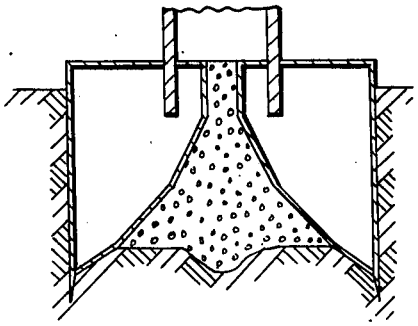
FIG. 17 shows the foot of the leg of FIG. 15 after backfilling and removal of the cutter.
Figure 18:
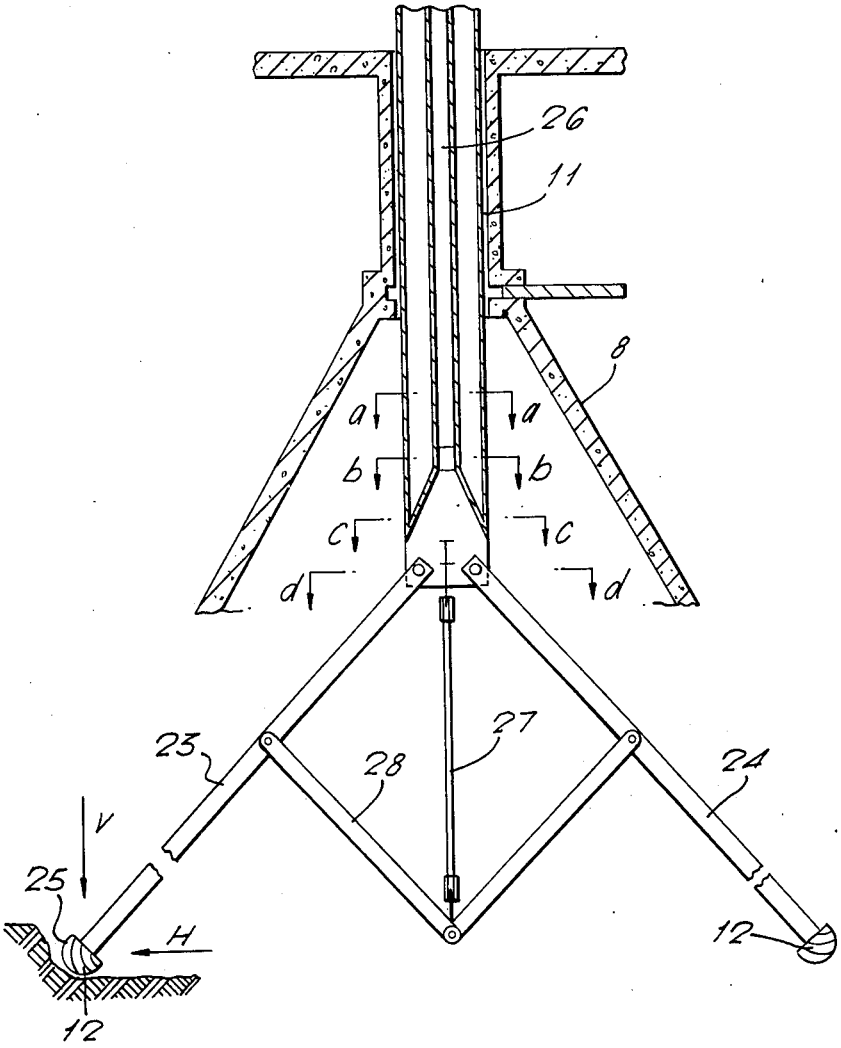
FIG. 18 shows on an enlarged scale a cutter in use in the foot of FIG. 17.
Figures 19, 20, 21, 22:
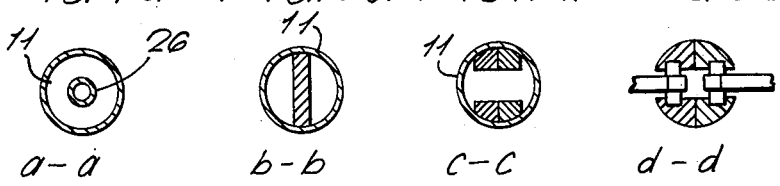
FIGS. 19–22 show respectively cross sections on the lines *a—a, b—b, c—c* and *d—d* of FIG. 18.

FIGS. 15 and 16 show an alternative construction of means of excavating the sea bed within the foot. The leg or column 1 has within it a pipe 11 extending downwardly through which passes a suction pipe 22 branching out at its lower end within the foot 5 into the suction pipes 23, 24 each carrying a cutter 25 at its end. The upper end of the pipe 22 is connected at 26 to a source of reduced pressure. A lifting tackle on the superstructure 20 includes a wire or cable 27 extending down through the pipe 11 and connected at its lower end to toggles 28 pivoted to the pipes 23, 24 whereby the pipes 23, 24 can be spaced apart to move the cutters 25 into engagement with the sea bed round the periphery of the foot 5. The cutters may be rotatable or otherwise operable by controls passing down the suction pipes from the superstructure to excavate the sea bed within the foot, the resultant debris being sucked up through the pipe 22. The cutting action can be enhanced by the downward thrust of the pipes 22, 23, 24 by gravity due to the weight of the cutter and pipe assembly or the assembly may be forced downwardly by suitable means controlled from the superstructure. The natural action of the pipes 23, 24 is to spread apart under their own weight so that the excavation is carried out by a series of radial cuts of the cutters, the pipes 23, 24 being rotated within the foot when the weight of the assembly is supported off the sea bed by means controlled from the superstructure. Alternatively the pipe 22 may extend downwardly between the toggles 28 and the pipes 23, 24 may then be rods carrying radially inwardly directed drag teeth so that the toggles are actuated to spread the rods and then draw them back with the teeth drawing debris to the center where the suction pipe removes it.

In another way of constructing the structure the upper cross bracings 3 are prefabricated out of steel, and erected in a dry dock and connected to the ends of the columns 1 as they are being constructed, starting from their top ends. As the lengths of the columns 1 is being built up the next set of cross bracings, i.e., the top bracings 4, are connected into the columns and this process is repeated until the structure is complete but without the feet 5 or the superstructure 20.

At the same time the three feet 5 can be constructed for example vertically and upside down working upwardly. The structure and the feet are floated into shallow water and the feet are mounted on the lower ends of the columns 1 as by cementing or concreting by conventional methods. The feet and structure may be united with a final prestressing operation in a conventional manner.

It will be understood that by constructing the structure in the manner described above in a horizontal position the design and construction of the feet can be left until a late stage in the overall program enabling up-to-date survey of the sea bed to be used in designing and constructing the feet 5 to suit the sea bed conditions. With the feet well buried in the sea bed and the possibility of draining the feet properly it is possible to take into account the anchoring effect against the cyclic wave loads operating against the structure and thus be able to make the structure considerably lighter than more conventional structures at present being built. It will be understood that weight can be added to the structure by pumping the amount of ballast required into the hollow feet, the columns and/or bracing members.

Compared with existing known structures erected or being built the structure of the present invention is considerably lighter indicating that the material from which it is made, be it steel, reinforced or prestressed concrete has been used to good advantage. Furthermore, due to its lightness and considerable natural buoyancy, the differential water pressure between water within and outside the structure members on any of the members during the sinking and upending process can be kept within such limits that this loading case becomes far less severe than for the structures presently being built, where the compression due to external water pressure often governs the wall thicknesses. It also enables the structure to be built in shallower water than known structures and because of its smaller mass and because it is floating horizontally and therefore is less exposed to wind forces, it requires less tugboat power to be towed and kept under control.

The method of digging the three feet into the sea bed to reach a reliable foundation level provides a good foundation system for the structure even where the sea bed conditions and topography are not well defined. It is a major advantage that any amount of deck load and equipment can be applied to the structure in sheltered water before the towing starts, permitting drilling or other operations for which the structure is intended to start immediately it has been safely founded in the sea bed in a matter of a few days after touching down. It is possibly an even greater advantage that the structure naturally divides into two structures with the top part being a completely independent jack-up platform, the installation of which only requires a very short spell of calm weather (3 to 4 hours). This not only promises a quick start on the oil drilling and production, but it promises an equally quick dismantling and start somewhere else. Moreover the structure is comparatively independent of weather conditions even during the upending and sinking operations since this operation is of short duration, 8–10 hours, and the structure becomes less and less vulnerable to winds and waves as the operation proceeds. This could lead to such confidence in the safety of the offshore operation that one might consider installing the structure during even the shortest weather window, that is the required starting conditions and a reasonable 12-hour weather forecast.

Finally, since the whole operation can be halted at any stage and even reversed it is also possible at a later stage to recover the structure by deballasting and refloating it.

I claim:

1. A method of constructing a marine structure comprising making three hollow columns, bracing the columns together adjacent their end portions with bracing members at right angles thereto and between their end portions with bracing members diagonally thereto to form a horizontally disposed rigid buoyant structure such that when erected on the sea bed said bracing members at right angles will be horizontal members beyond the critical wave zone with said diagonally extending bracing members situated between said end portions, assembling hollow feet on the columns, floating the structure to the site with the columns substantially horizontal, ballasting one end portion of the columns to upend the structure into a substantially vertical position and to sink the structure onto the sea bed, and excavating the sea bed within the feet to enable the structure to be seated firmly in the upright position at a suitable foundation depth in the sea bed.

2. A method according to claim 1 wherein the braced column structure and the feet are made separately and the feet are secured to the lower ends of the columns while the feet and the structure are afloat.

3. A method according to claim 1 wherein a superstructure is mounted on the tops of the columns.

4. A method according to claim 2 wherein the superstructure is made separately from the column structure and mounted on the tops of the columns at the erecting site location before or after the column structure has been upended.

5. A method according to claim 1 wherein buoyancy tanks are connected to the column structure to facilitate the upending of the structure.

6. A method according to claim 1 wherein excavating means are disposed within the feet and operable to excavate the sea bed within the feet when the upended structure sinks into engagement within the sea bed.

7. A method according to claim 1 wherein each foot comprises a cone-like section surrounded at least at its lower portion by a sleeve and the actuating means for excavating devices within the foot are connected to control devices through the section and/or the sleeve.

8. A method according to claim 1 wherein a suction device is disposed with its inlet within the section to extract from the foot debris dislodged by the excavating means.

9. A marine structure comprising three substantially vertical columns, braces within the lengths of said columns secured to said columns thereby forming a rigid tower, the braces adjacent lower and upper portions of said columns extending generally horizontally in the erected condition of said structure, said braces adjacent the lower portions of said columns also being adjacent to the sea bed in the erected structure and the braces adjacent to upper portions of said columns being disposed at the upper end of the structure above the highest eave crest possible at the site, the braces within the lengths of the columns between said horizontally extending braces extending substantially diagonally in the erected condition of said structure whereby there are no horizontally extending braces in the critical wave zone, a foot secured to the lower end of each column to be sunk into the sea bed, and means for excavating sea bed soil material within each foot.

10. A marine structure according to claim 9 wherein the braces diagonally extending within the lengths of the columns are formed in sets fixed between adjacent columns, each set comprising two crossed members secured to the columns.

11. A marine structure according to claim 9 wherein each column has a hollow foot open at its lower end and said excavating means are disposed within the foot, and means of access to the interior of the foot are provided through which pass means for actuating the excavating means.

12. A marine structure according to claim 9 wherein each column is floatable in water and includes means for filling it with ballast to sink it vertically in the water.

13. A marine structure according to claim 9 wherein said braces adjacent the upper portions of said columns form part of a deck structure.

* * * * *